US007243062B2

(12) United States Patent
Wark

(10) Patent No.: US 7,243,062 B2
(45) Date of Patent: Jul. 10, 2007

(54) AUDIO SEGMENTATION WITH ENERGY-WEIGHTED BANDWIDTH BIAS

(75) Inventor: Timothy John Wark, Ryde (AU)

(73) Assignee: Canon Kabushiki Kaisha, Tokyo (JP)

( * ) Notice: Subject to any disclaimer, the term of this patent is extended or adjusted under 35 U.S.C. 154(b) by 887 days.

(21) Appl. No.: 10/279,720

(22) Filed: Oct. 25, 2002

(65) Prior Publication Data

US 2003/0097269 A1 May 22, 2003

(30) Foreign Application Priority Data

Oct. 25, 2001 (AU) ..... PR8470
Oct. 25, 2001 (AU) ..... PR8471

(51) Int. Cl.
*G10L 11/06* (2006.01)
*G10L 21/00* (2006.01)

(52) U.S. Cl. ..... 704/214; 704/208

(58) Field of Classification Search ..... 704/208, 704/214

See application file for complete search history.

(56) References Cited

U.S. PATENT DOCUMENTS 6,140,874 A * 10/2000 French et al. ..... 330/149
6,424,946 B1 * 7/2002 Tritschler et al. ..... 704/272
7,006,568 B1 * 2/2006 Gu et al. ..... 375/240.11
2003/0231775 A1 * 12/2003 Wark ..... 381/56

OTHER PUBLICATIONS

Tritschler et al. "Improved speaker segmentation and segments clustering using the Bayesian Information Criterion," in Proc. EUROSPEECH, Budapest, Hungary, 1999, vol. 2, pp. 679-682.*

Sivakumaran, et al. "On the use of the Bayesian Information Criterion in multiple speaker detection," in Proc. EUROSPEECH, Aalborg, Denmark, 2001, vol. 2, pp. 795-798.*

Zhang et al. "Statistical modelling of speech signals," Proceedings of the Sixth International Conference on Signal Processing ICSP 2002, Beijing, China, vol. 1, pp. 480-483, Aug. 2002.*

Matthew Harris, et al., "A Study Of Broadcast News Audio Stream Segmentation And Segment Clustering", Philips Research Laboratories.

(Continued)

*Primary Examiner*—Tālivaldis Ivars Šmits
*Assistant Examiner*—Eunice Ng
(74) *Attorney, Agent, or Firm*—Fitzpatrick, Cella, Harper & Scinto

(57) ABSTRACT

A method (200) and apparatus (100) for segmenting a sequence of audio samples into homogeneous segments (550 and 555) are disclosed. The method (200) forms a sequence of frames (701 to 704) along the sequence of audio samples, and extracts, for each frame, a data feature. The data features form a sequence of data features. Transition points in the sequence of data features are thin detected by applying the Bayesian Information Criterion to the sequence of data features. The transition points define the homogeneous segments (550 and 555). Preferably the data feature is single-dimensional and a leptokurtic distribution is used as an event model in the Bayesian Information Criterion.

10 Claims, 9 Drawing Sheets

OTHER PUBLICATIONS

Bowen Zhou, et al., "Unsupervised Audio Stream Segmentation And Clustering Via The Bayesian Information Criterion", Robust Speech Processing Laboratory, The Center for Spoken Language Research, University of Colorado at Boulder.

Scott Shaobing Chen, et al., "Speaker, Environment And Channel Change Detection And Clustering Via The Bayesian Information Criterion", IBM T.J. Watson Research Center.

Javier Ferreiros, et al., "Acoustic Change Detection And Clustering On Broadcast News", International Computer Science Institute, pp. 1-22 (Mar. 2000).

* cited by examiner

AUDIO SEGMENTATION WITH ENERGY-WEIGHTED BANDWIDTH BIAS

TECHNICAL FIELD OF THE INVENTION

The present invention relates generally to the segmentation of audio streams and, in particular, to the use of the Bayesian Information Criterion as a method of segmentation.

BACKGROUND ART

There is an increasing demand for automated computer systems that extract meaningful information from large amounts of data. One such application is the extraction of information from continuous streams of audio. Such continuous audio streams may include speech from, for example, a news broadcast or a telephone conversation, or non-speech, such as music or background noise.

In order for a system to be able to extract information from the continuous audio stream, the system is typically first required to segment the continuous audio stream into homogeneous segments, each segment including audio from only one speaker or other constant acoustic condition. Once the segment boundaries have been located, each segment may be processed individually to, for example, classify the information contained within each of the segments.

Whilst a number of techniques have been proposed in a somewhat ad-hoc manner for segmenting audio in specific applications, one of the most successful approaches that has been used is an approach based on the Bayesian Information Criterion (BIC). The BIC is a model selection criterion known in statistical literature and is used to determine the positions of segment boundaries by determining the most likely positions where the signal characteristics change. When applied to audio segmentation, the BIC is used to determine whether a section of audio is better described by one statistical model or two different statistical models, hence allowing a segmentation decision to be made. It also gives a criterion to determine whether the change at this point is significant, or not.

Previous systems performing audio segmentation with the BIC have made the assumption that the statistical model characterising each audio segment is a Gaussian process. However, the Gaussian model tends not to hold very well when only a small amount of data is available for the audio stream between segment changes. Thus, segmentation performs very poorly with the Gaussian BIC under these conditions.

Another major setback for BIC-based segmentation systems is the computation time required to segment large audio streams. This is due to the fact that previous BIC systems have used multi-dimensional features for describing important characteristics within the audio stream, such multi-dimensional features being those of the mel-cepstral vectors or linear predictive coefficients.

SUMMARY OF THE INVENTION

It is an object of the present invention to substantially overcome, or at least ameliorate, one or more disadvantages of existing arrangements.

According to an aspect of the invention, there is provided a method of segmenting a sequence of audio samples into a plurality of homogeneous segments, said method comprising the steps of:

(a) forming a sequence of frames along said sequence of audio samples, each said frame comprising a number of said audio samples;

(b) extracting, for each said frame, a single-dimensional data feature, said data features forming a sequence of said data features each corresponding to one of said frames; and (c) detecting one or more transition points in said sequence of data features by applying the Bayesian Information Criterion to said sequence of data features, said transition points defining said homogeneous segments.

Other aspects of the invention are also disclosed.

BRIEF DESCRIPTION OF THE DRAWINGS

One or more embodiments of the present invention will now be described with reference to the drawings, in which.

DETAILED DESCRIPTION INCLUDING BEST MODE

Figure 1:
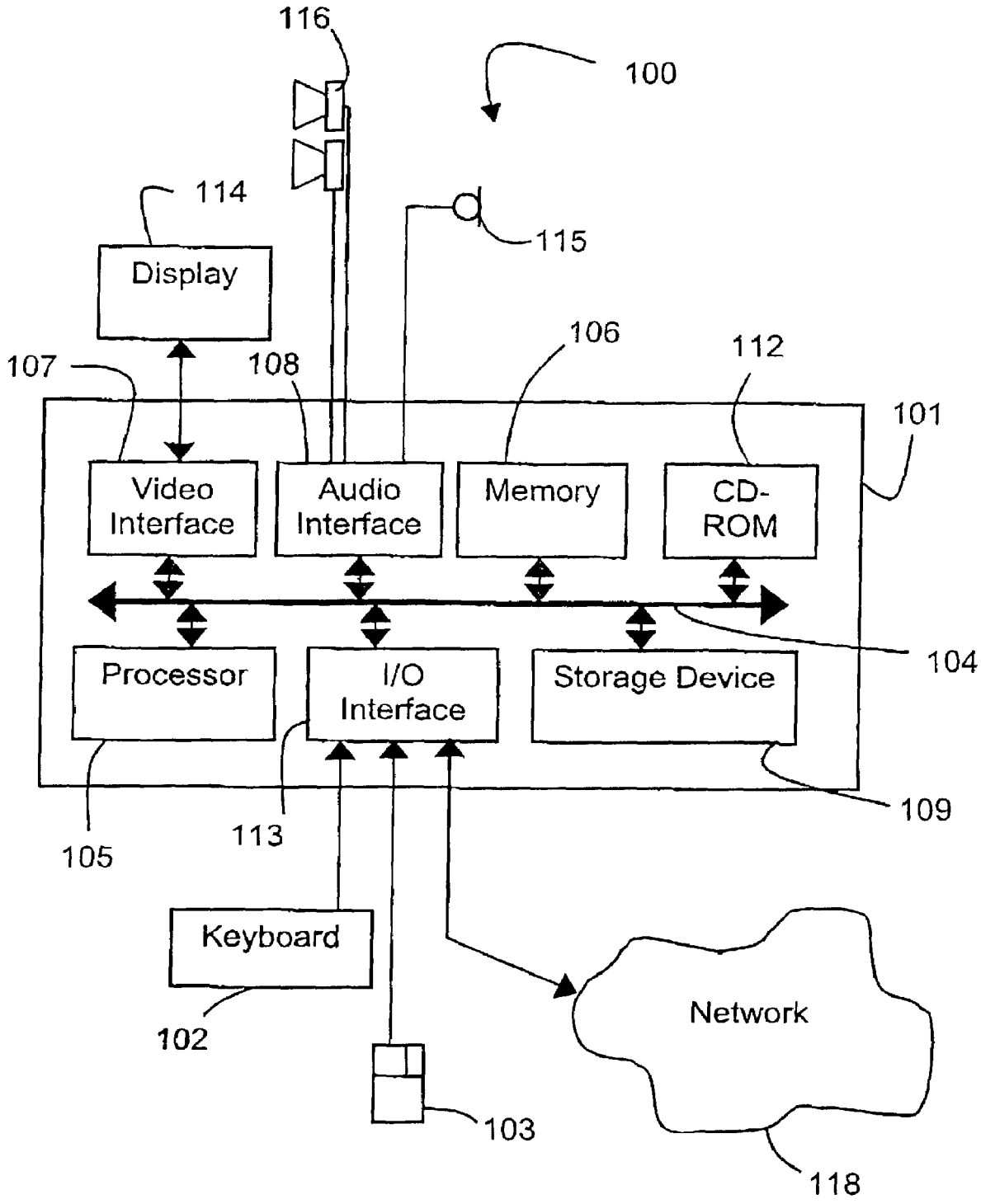
FIG. 1 shows a schematic block diagram of a system upon which audio segmentation can be practiced.

Some portions of the description which follow are explicitly or implicitly presented in terms of algorithms and symbolic representations of operations on data within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated.

It should be borne in mind, however, that the above and similar terms are to be associated with the appropriate physical quantities and are merely convenient labels. Unless specifically stated otherwise, and as apparent from the following, it will be appreciated that throughout the present specification, discussions refer to the action and processes of a computer system, or similar electronic device, that manipulates and transforms data represented as physical (electronic) quantities within the registers and memories of the computer system into other data similarly represented as physical quantities within the computer system memories or registers or other such information storage, transmission or display devices.

Where reference is made in any one or more of the accompanying drawings to steps and/or features, which have the same reference numerals, those steps and/or features have for the purposes of this description the same function(s) or operation(s), unless the contrary intention appears.

FIG. 1 shows a schematic block diagram of a system 100 upon which audio segmentation can be practiced. The system 100 comprises a computer module 101, such as a conventional general-purpose computer module, input devices including a keyboard 102, pointing device 103 and a microphone 115, and output devices including a display device 114 and one or more loudspeakers 116.

The computer module 101 typically includes at least one processor unit 105, a memory unit 106, for example formed from semiconductor random access memory (RAM) and read only memory (ROM), input/output (I/O) interfaces including a video interface 107 for the video display 114, an I/O interface 113 for the keyboard 102, the pointing device 103 and interfacing the computer module 101 with a network 118, such as the Internet, and an audio interface 108 for the microphone 115 and the loudspeakers 116. A storage device 109 is provided and typically includes a hard disk drive and a floppy disk drive. A CD-ROM or DVD drive 112 is typically provided as a non-volatile source of data. The components 105 to 113 of the computer module 101, typically communicate via an interconnected bus 104 and in a manner which results in a conventional mode of operation of the computer module 101 known to those in the relevant art.

Audio data for processing by the system 100, and in particular the processor 105, may be derived from a compact disk or video disk inserted into the CD-ROM or DVD drive 112 and may be received by the processor 105 as a data stream encoded in a particular format. Audio data may alternatively be derived from downloading audio data from the network 118. Yet another source of audio data may be recording audio using the microphone 115. In such a case, the audio interface 108 samples an analog signal received from the microphone 115 and provides the audio data to the processor 105 in a particular format for processing and/or storage on the storage device 109.

The audio data may also be provided to the audio interface 108 for conversion into an analog signal suitable for output to the loudspeakers 116.

Figure 2:
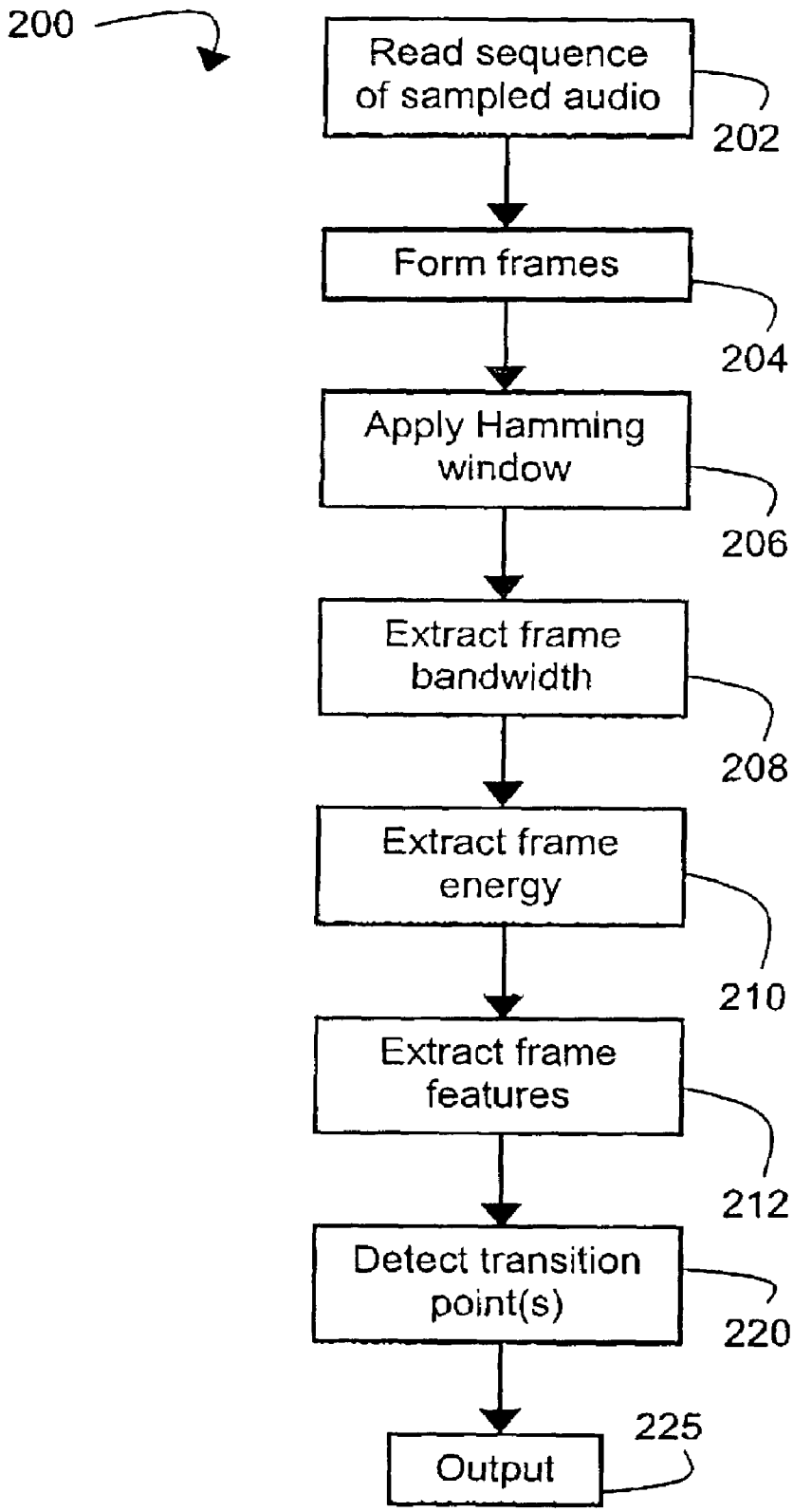
FIG. 2 shows a flow diagram of a method for segmenting a sequence of sampled audio from unknown origin into homogeneous segments.

FIG. 2 shows a flow diagram of a method 200 of segmenting an audio stream in the form of a sequence x(n) of sampled audio from unknown origin into homogeneous segments. The method 200 is preferably implemented in the system 100 by a software program executed by the processor 105. A homogeneous segment is a segment only containing samples from a source having constant acoustic characteristic, such as from a particular human speaker, a type of background noise, or a type of music. It is assumed that the audio stream is appropriately digitised at a sampling rate F. Those skilled in the art would understand the steps required for converting an analog audio stream into the sequence x(n) of sampled audio. In an example arrangement, the audio stream is sampled at a sampling rate F of 16 kHz and the sequence x(n) of sampled audio is stored on the storage device 109 in a form such as a .wav file or a .raw file. The method 200 starts in step 202 where the sequence x(n) of sampled audio are read from the storage device 109 and placed in memory 106.

Figure 7:
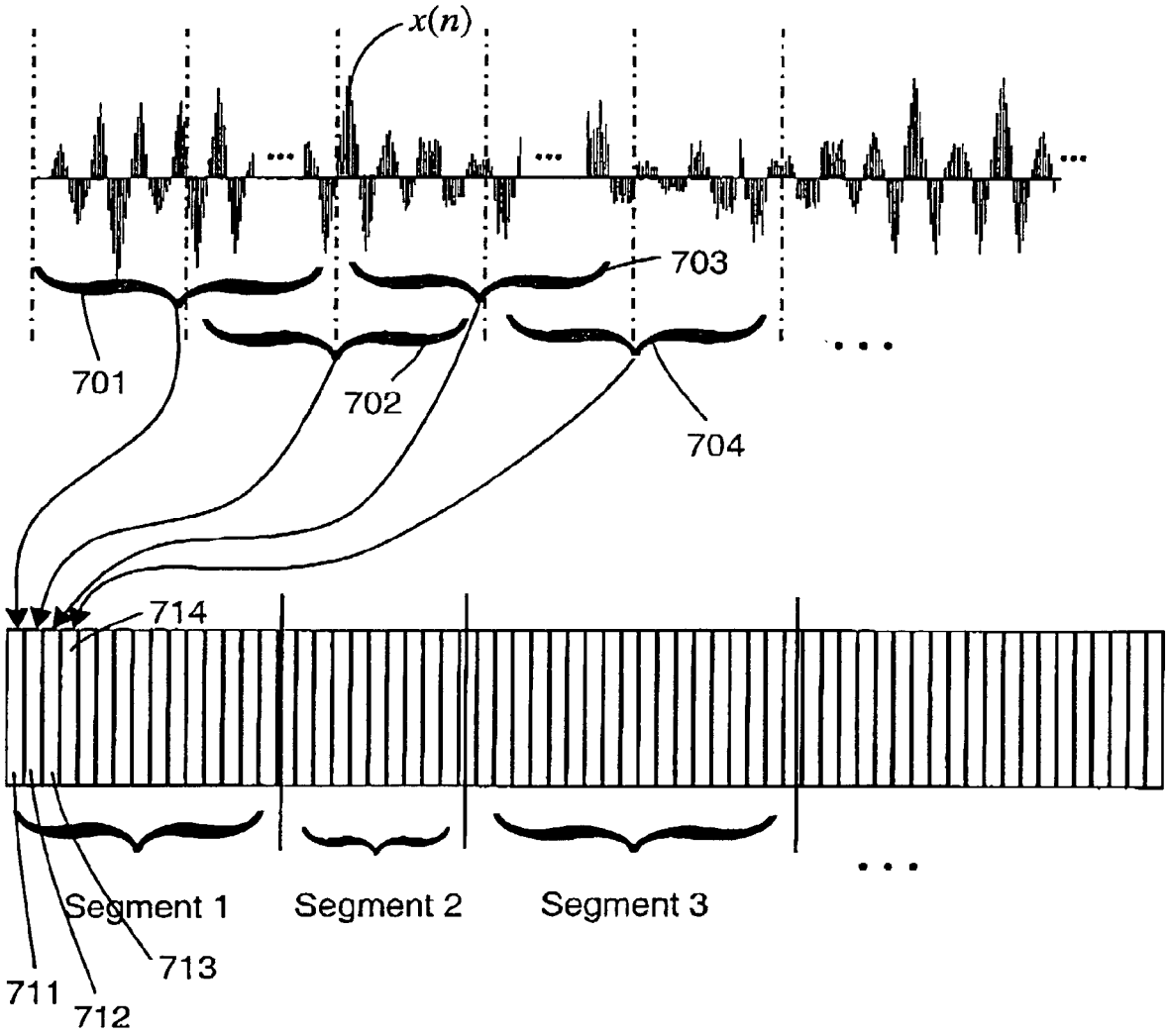
FIG. 7 illustrates the formation of frames from the sequence of audio samples, the extraction of the sequence frame features, and the detection of segments within the sequence of frame features.

FIG. 7 illustrates such a sequence x(n) of sampled audio. In order for the Bayesian Information Criterion (BIC) to be applied to the sequence x(n) of sampled audio, one or more features must be extracted for each small, incremental interval of K samples along the sequence x(n). An underlying assumption is that the properties of the audio signal change relative slowly in time, and that each extracted feature provides a succinct description of important characteristics of the audio signal in the associated interval. Ideally, such features extract enough information from the underlying audio signal so that the subsequent segmentation algorithm can perform well, and yet be compact enough that segmentation can be performed very quickly.

Referring again to FIG. 2, in step 204 the processor 105 forms interval windows or frames, each containing K audio samples. In the example, a frame of 20 ms is used, which corresponds to K=320 samples at the sampling rate F of 16 kHz. Further, the frames are overlapping, with the start position of the next frame positioned only 10 ms later in time, or 160 samples later, providing a shift-time of 10 ms. The forming of frames 701 to 704 and extraction of features 711 to 714 are also illustrated in FIG. 7.

Referring again to FIG. 2, in step 206 a Hamming window function of the same length as that of the frames, i.e. K samples long, is applied by the processor 105 to the sequence samples x(n) in each frame to give a modified set of windowed audio samples s(i,k) for frame i, with $k \in 1, \ldots, K$. The purpose of applying the Hamming window is to reduce the side-lobes created when applying the Fast Fourier Transform (FFT) in subsequent operations.

In step 208 the bandwidth BW(i) of the modified set of windowed audio samples s(i,k) of the i'th frame is calculated by the processor 105 as follows:

$$BW(i) = \sqrt{\frac{\int_0^\infty (\omega - FC(i))^2 S_i(\omega)\, d\omega}{\int_0^\infty S_i(\omega)\, d\omega}} \tag{1}$$

where $S_i(\omega)$ is the power spectrum of the modified windowed audio samples s(i,k) of the i'th frame, ω is a signal frequency variable for the purposes of calculation, and FC is the frequency centroid, defined as:

$$FC(i) = \frac{\int_0^\infty \omega |S_i(\omega)|^2\, d\omega}{|S_i(\omega)|^2} \tag{2}$$

The Simpson's integration is used to evaluate the integrals. The Fast Fourier Transform is used to calculate the power spectrum $S_i(\omega)$ whereby the samples s(i,k), having length K, are zero padded until the next highest power of 2 is reached. Thus, in the example where the length of the samples s(k) is 320, the FFT would be applied to a vector of length 512, formed from 320 modified windowed audio samples s(i,k) and 192 zero components.

In step 210 the energy E(i) of the modified set of windowed audio samples s(i,k) of the i'th frame is calculated by the processor 105 as follows:

$$E(i) = \sqrt{\frac{1}{K}\sum_{k=1}^{K} s^2(i,k)} \tag{3}$$

A frame feature f(i) for each frame i is calculated by the processor 105 in step 212 by weighting the frame bandwidth BW(i) by the frame energy E(i). This forces a bias in the measurement of bandwidth BW(i) in those frames i that exhibit a higher energy E(i), and are thus more likely to come from an event of interest, rather than just background noise. The frame feature f(i) is thus calculated as being:

$$f(i)=E(i)BW(i) \tag{4}$$

Steps 206 to 212 jointly extract the frame feature f(i) from the sequence x(n) of audio samples and the frame i. The frame feature f(i) shown in Equation (4) is a single dimensional feature providing a great reduction in the computation time when it is applied to the Bayesian Information Criterion over systems that use a multi-dimensional feature vector f(i), such as mel-cepstral vectors or linear predictive coefficients. Mel-cepstral features seek to extract information from a signal by "binning" the magnitudes of the power spectrum in bills centred at various frequencies. A Discrete Cosine Transform (DCT) is then applied in order to produce a vector of coefficients, typically in the order of 12 to 16. In a similar way linear-predictive coefficients (LPC) are derived by modelling the signal as an auto-regressive (AR) time-series, where the coefficients of the time-series become the features f(i) again having a dimension of 12 to 16.

The BIC is used in step 220 by the processor 105 to segment the sequence of frame features f(i) into homogeneous segments, such as the segments illustrated in FIG. 7. The output of step 220 is one or more frame numbers of the frames where changes in acoustic characteristic were detected. In order to provide the output in a user-friendly manner, the processor 105 converts each frame number received from step 220 into time in seconds, the time being from the start point of the audio signal. This conversion is done by the processor 105 in step 225 by multiplying each output frame number by the window-shift. In the example where the window-shift of 10 ms is used, the output frame numbers are multiplied by 10 ms to get the segment boundaries in seconds.

In an alternative arrangement where the audio data is associated with a video sequence, the output may be stored as metadata of the video sequence. The metadata may be used to assist in segmentation of the video, for example.

The BIC used in step 220 will now be described in more detail. The value of the BIC is a statistical measure for how well a model represents a set of features f(i), and is calculated as:

$$BIC = \log(L) - \frac{D}{2}\log(N) \tag{5}$$

where L is the maximum-likelihood probability for a chosen model to represent the set of features f(i), D is the dimension of the model which is 1 when the frame feature f(i) of Equation (4) is used, and N is the number of features f(i) being tested against the model.

The maximum-likelihood L is calculated by finding the parameters θ of the model that maximise the probability of the features f(i) being from that model. Thus, for a set of parameters θ, the maximum-likelihood L is:

$$L = \max_{\theta} P(f(i)\,|\,\theta) \tag{6}$$

Segmentation using the BIC operates by testing whether the sequence of features f(i) arc better described by a single-distribution event model, or a twin-distribution event model, where the first m number of frames, those being frames [1, . . . , m], are from a first source and the remainder of the N frames, those being frames [m+1, . . . , N], are from a second source. The frame m is accordingly termed the change-point. To allow a comparison, a criterion difference ΔBIC is calculated between the BIC using the twin-distribution event model with that using the single-distribution event-model. As the change-point m approaches a transition in acoustic characteristics, the criterion difference ΔBIC typically increases, reaching a maximum at the transition, and reducing again towards the end of the N frames under consideration. If the maximum criterion difference ΔBIC is above a predefined threshold, then the two-distribution event model is deemed a more suitable choice, indicating a significant transition in acoustic characteristics at the change-point m where the criterion difference ΔBIC reached a maximum.

Current BIC segmentation systems assume that the features f(i) are best represented by a Gaussian event model having a probability density function of the form:

$$g\left(f(i), \mu, \sum\right) = \frac{1}{(2\pi)^{\frac{D}{2}}\left|\sum\right|^{\frac{1}{2}}}\exp\left\{-\frac{1}{2}(f(i)-\mu)^T\sum^{-1}(f(i)-\mu)\right\} \tag{7}$$

where μ is the mean vector of the features f(i), and Σ is the covariance matrix.

Figure 5A:
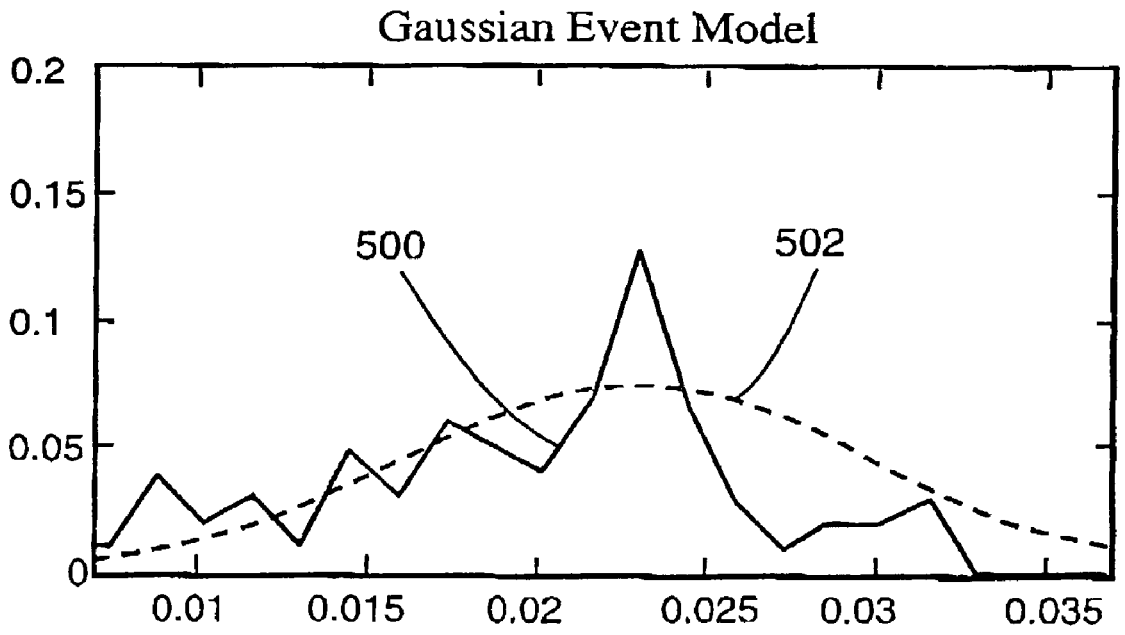
FIG. 5A illustrates a distribution of example frame features and the distribution of a Gaussian event model that best fits the set of frame features obtained from a segment of speech.

FIG. 5A illustrates a distribution 500 of frame features f(i), where the frame features f(i) were obtained from an audio stream of duration 1 second containing voice. Also illustrated is the distribution of a Gaussian event model 502 that best fits the set of frame features f(i).

Figure 5B:
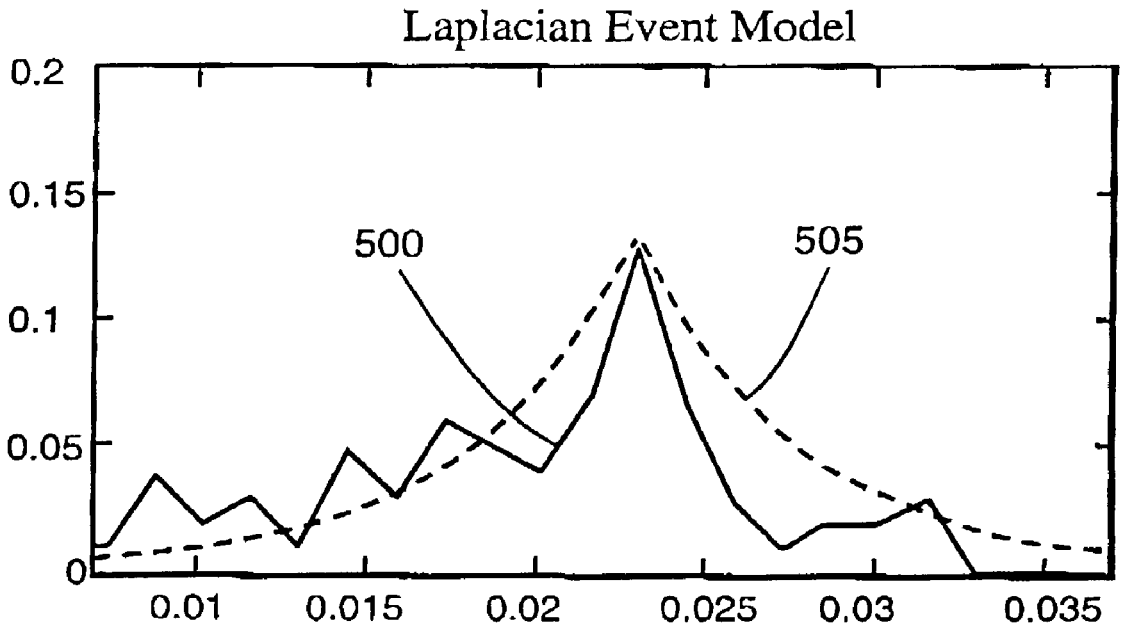
FIG. 5B illustrates a distribution of the example frame features of FIG. 5A and the distribution of a Laplacian event model that best fits the set of frame features.

It is proposed that frame features f(i) representing the characteristics of audio signals such as a particular speaker or block of music, is better represented by a leptokurtic distribution, particularly where the number N of features being tested against the model is small. A leptokurtic distribution is a distribution that is more peaky than a Gaussian distribution, such as a Laplacian distribution. FIG. 5B illustrates the distribution 500 of the same frame features f(i) as those of FIG. 5A: together with the distribution of a Laplacian event model 505 that best fits the set of frame features f(i). It can be seen that the Laplacian event model gives a much better characterisation of the feature distribution 500 than the Gaussian event model.

Figure 6A:
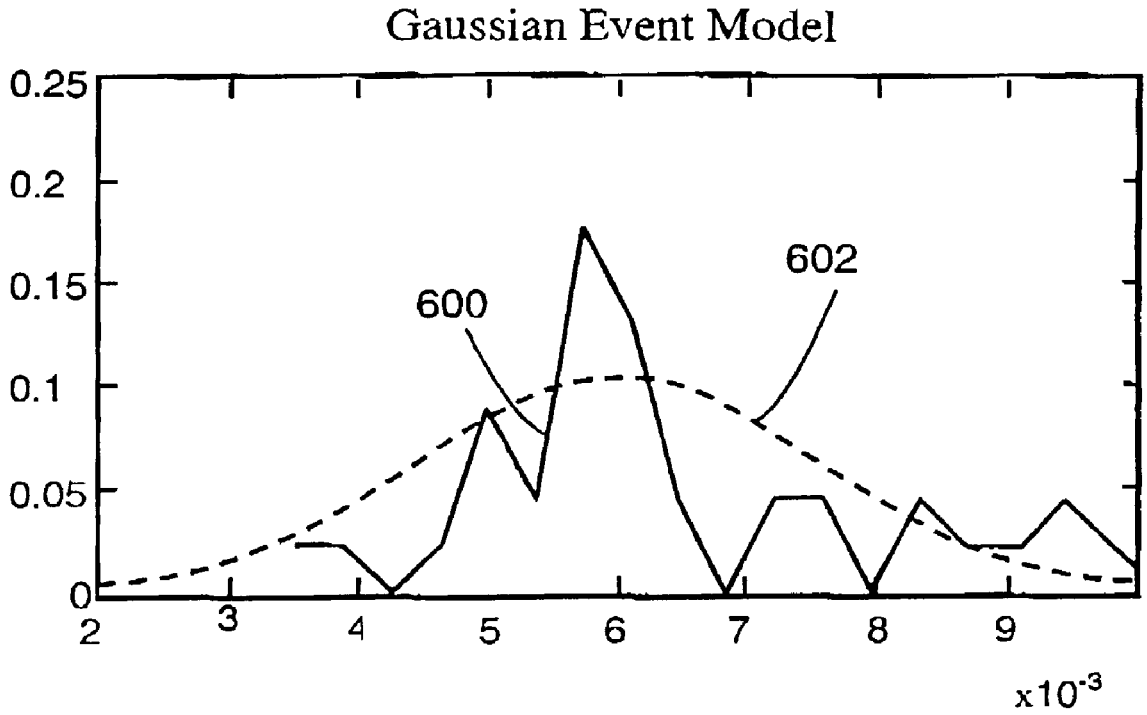
FIG. 6A illustrates a distribution of example frame features and the distribution of a Gaussian event model that best fits the set of frame features obtained from a segment of music.
Figure 6B:
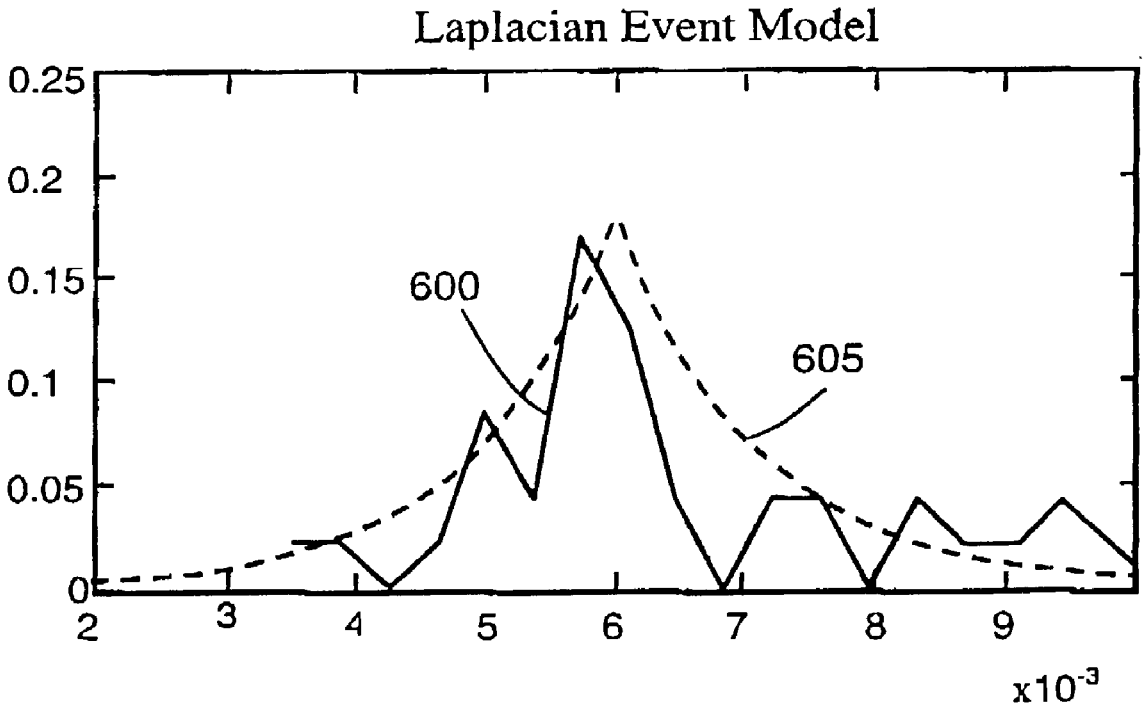
FIG. 6B illustrates a distribution of the example frame features of FIG. 6A and the distribution of a Laplacian event model that best fits the set of frame features.

This proposition is further illustrated in FIGS. 6A and 6B wherein a distribution 600 of frame features f(i) obtained from an audio stream of duration 1 second containing music is shown. The distribution of a Gaussian event model 602 that best fits the set of frame features f(i) is shown in FIG. 6A, and the distribution of a Laplacian event model 605 is illustrated in FIG. 6B.

A quantitative measure to substantiate that the Laplacian distribution provides a better description OF the distribution characteristics of the features f(i) for short events rather than the Gaussian model is the Kurtosis statistical measure κ, which provides a measure of the "peakiness" of a distribution and may be calculated for a sample set X as:

$$\kappa = \frac{E(X - E(X))^4}{(\mathrm{var}(X))^2} - 3 \tag{8}$$

For a true Gaussian distribution, the Kurtosis measure will be 0, whilst for a true Laplacian distribution the Kurtosis measure will be 3. In the case of the distributions 500 and 600 shown in FIGS. 5A and 6A, the Kurtosis measures κ were 2.33 and 2.29 respectively, hence the distributions 500 and 600 are more Laplacian in nature rather than Gaussian.

The Laplacian probability density function in one dimension is:

$$g(f(i), \mu, \sigma) = \frac{1}{\sqrt{2}\,\sigma}\exp\left\{\frac{\sqrt{2}\,|f(i) - \mu|}{\sigma}\right\} \tag{9}$$

where μ is the mean of the frame features f(i) and σ is their standard deviation. In a higher order feature space with frame features f(i), each having dimension D, the feature distribution is represented as:

$$g(f(i), \mu, \Sigma) = \frac{2}{(2\pi)^{\frac{D}{2}}|\Sigma|^{\frac{1}{2}}} \left\{\frac{(f(i) - \mu)^T\Sigma^{-1}(f(i) - \mu)}{2}\right\}^{\frac{v}{2}} K_v\left(\sqrt{2(f(i) - \mu)^T\Sigma^{-1}(f(i) - \mu)}\right) \tag{10}$$

where v=(2−D)/2 and $K_v(.)$ is the modified Bessel function of the third kind.

Whilst the method 200 can be used with multi-dimensional features f(i), the rest of the analysis is contained to the one-dimensional space due to the use of the one-dimensional feature f(i) shown in Equation (4).

Figure 4A:
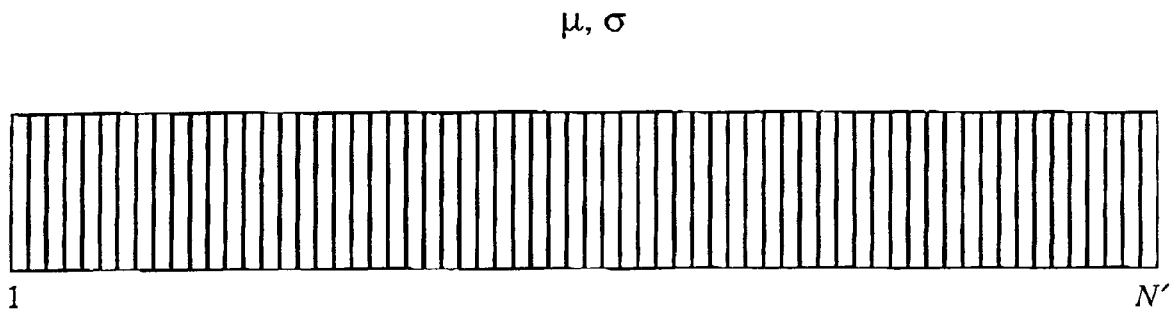
FIGS. 4A and 4B show a sequence of frames and the sequence or frames being divided at into two segments.

Given N frame features f(i) as illustrated in FIG. 4A, the maximum likelihood L for the set of frame features f(i) falling under a single Laplacian distribution is:

$$L = \prod_{i\omega 1}^{N}\left((2\sigma^2)^{-\frac{1}{2}}\exp\left(-\frac{\sqrt{2}}{\sigma}|f(i) - \mu|\right)\right) \tag{11}$$

where σ is the standard deviation of the frame features f(i) and μ is the mean of the frame features f(i). Equation (11) may be simplified providing:

$$L = (2\sigma^2)^{-\frac{N}{2}}\exp\left(-\frac{\sqrt{2}}{\sigma}\sum_{i=1}^{N}|f(i) - \mu|\right) \tag{12}$$

The maximum log-likelihood log(L), assuming natural logs, for all N frame features f(i) to fall under a single Laplacian event model is thus:

$$\log(L) = -\frac{N}{2}(2\sigma^2) - \frac{\sqrt{2}}{\sigma}\sum_{i=l}^{N}|f(i) - \mu| \tag{13}$$

Figure 4B:
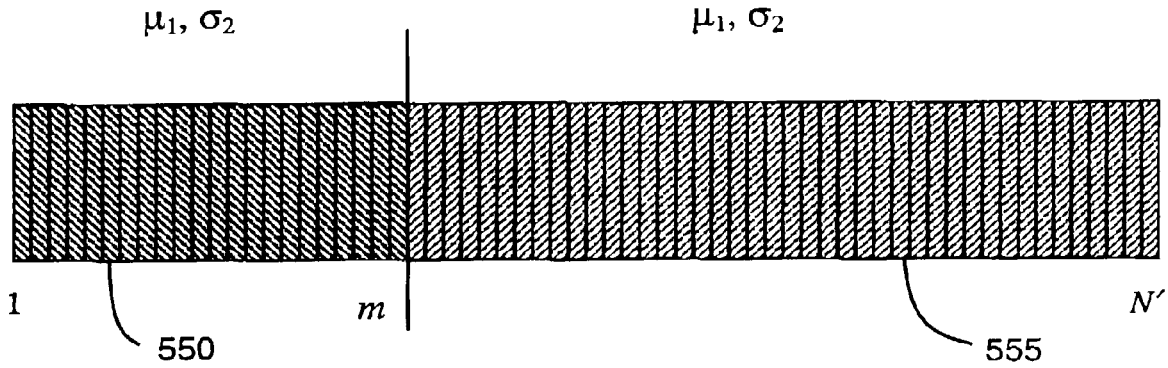

FIG. 4B shows the N frames being divided at frame m into two segments 550 and 555, with the first m number of frames [1, . . . , m] forming segment 550 and the remainder of the N frames [m+1, . . . , N] forming segment 555. A log-likelihood ratio R(m) of a twin-Laplacian distribution event model to a single Laplacian distribution event model, with the division at frame m and assuming segment 550 is from a first source and segment 555 is from a second source, is:

$$R(m) = \log(L_1) + \log(L_2) - \log(L) \tag{14}$$

where:

$$\log(L_1) = -\frac{m}{2}(2\sigma_1^2) - \frac{\sqrt{2}}{\sigma_1}\sum_{i=1}^{m}|f(i) - \mu_1| \tag{15}$$

and $$\log(L_2) = -\frac{(N - m)}{2}(2\sigma_2^2) - \frac{\sqrt{2}}{\sigma_2}\sum_{i=m+1}^{N}|f(i) - \mu_2| \tag{16}$$

wherein, $\{\mu_1,\sigma_1\}$ and $\{\mu_2,\sigma_2\}$ are the means and standard deviations of the frame features f(i) before and after the change point m.

The criterion difference ΔBIC for the Laplacian case having a change point m is calculated as:

$$\Delta BIC(m) = R(m) - \frac{D}{2}\log\left(\frac{m(N - m)}{N}\right) \tag{17}$$

In a simplest of cases where only a single transition is to be detected in a section of audio represented by a sequence of N frame features f(i), the most likely transition point m̂ is given by:

$$\hat{m} = arg(\max \Delta\mathrm{BIC}(m)) \tag{18}$$

Figure 3A:
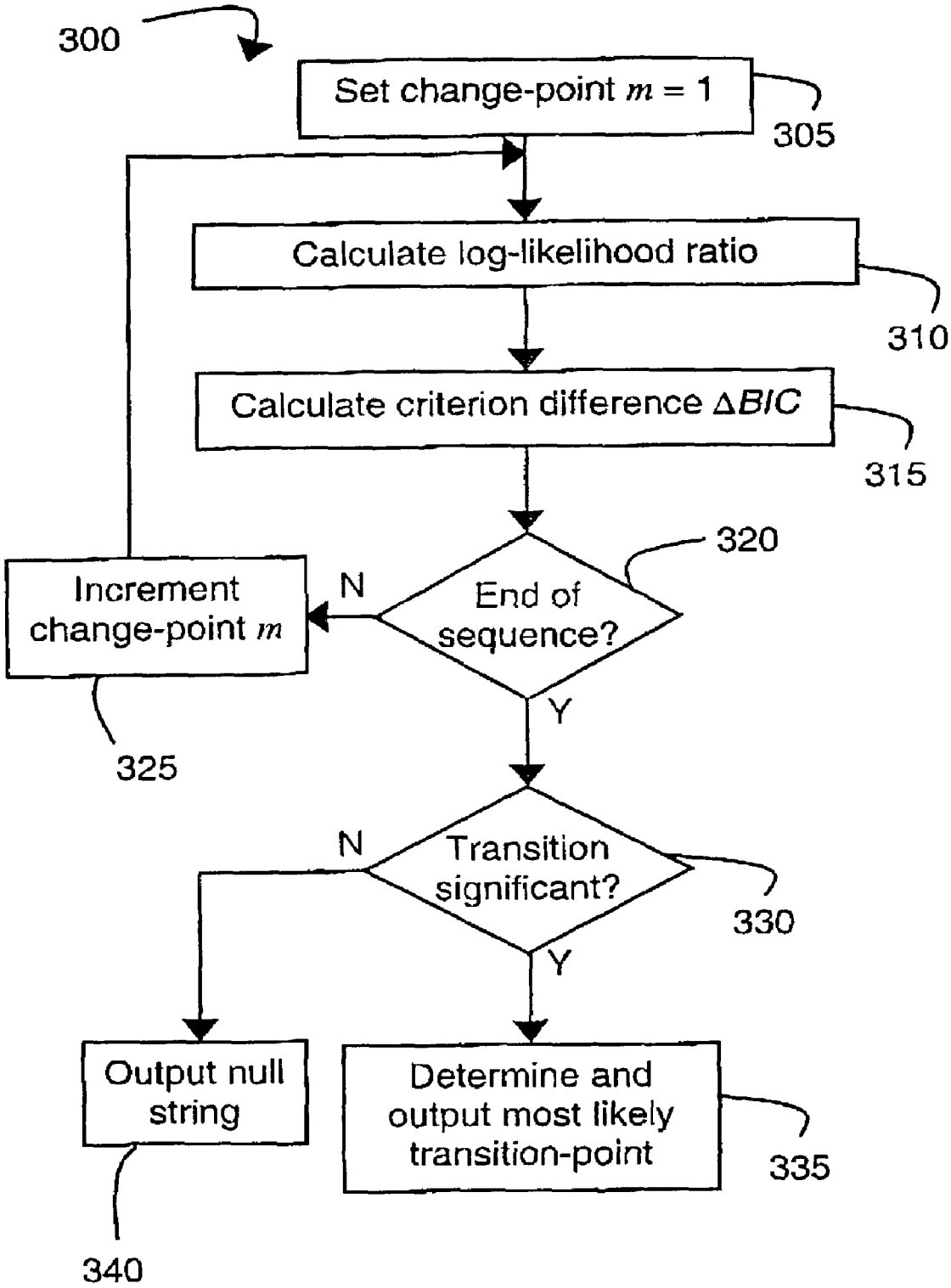
FIG. 3A shows a flow diagram of a method for detecting a single transition-point within a sequence of frame features.
Figure 3B:
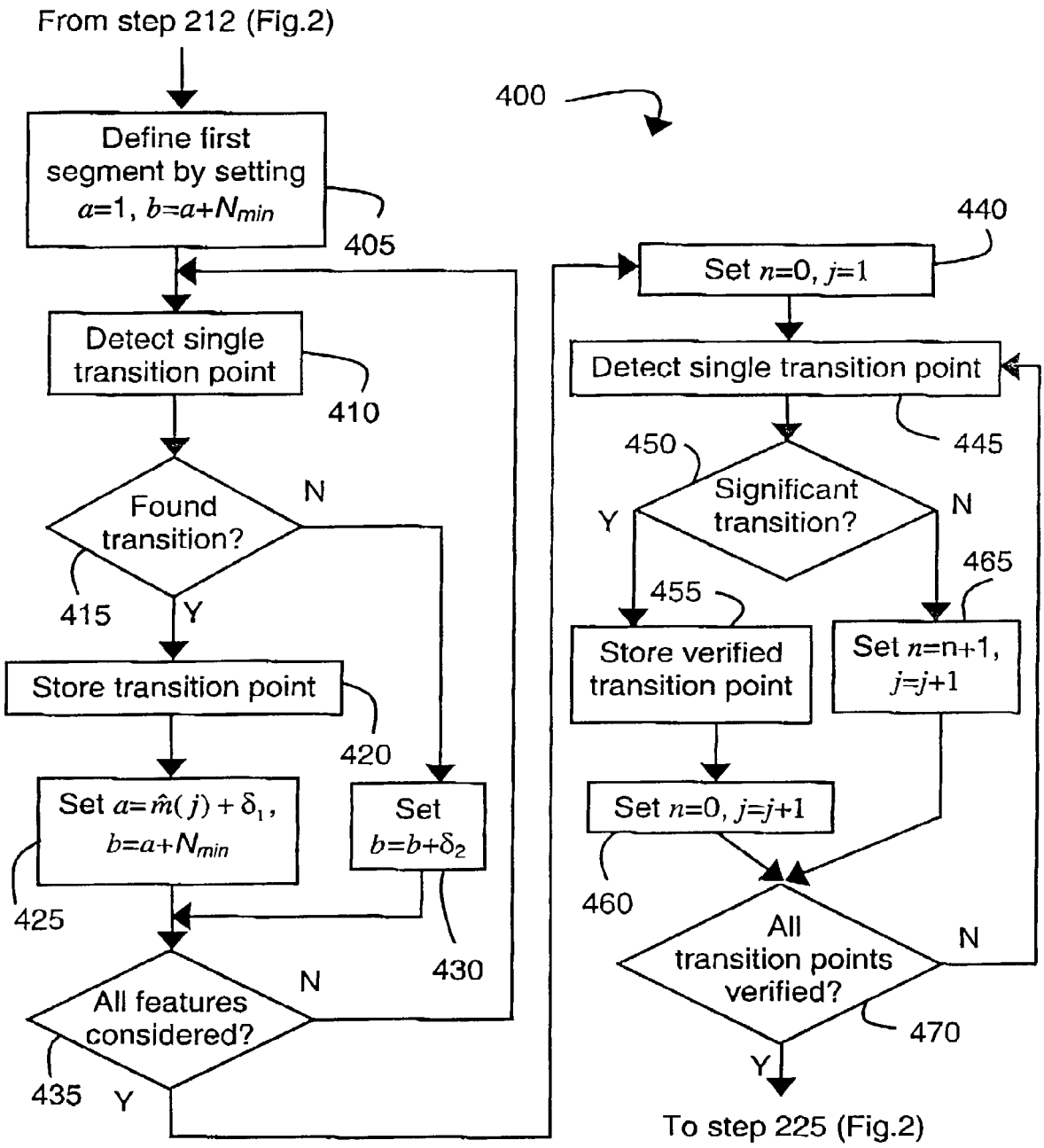
FIG. 3B shows a flow diagram of a method for detecting multiple transition-point within a sequence of frame features.

FIG. 3A shows a flow diagram of a method 300 for detecting a single transition-point m̂ within a sequence of N frame features f(i) that may be substituted as step 220 in method 200 shown in FIG. 2. When more than one transition-point m̂(j) is to be detected, the method 400 shown in FIG. 3B is substituted as step 220 in method 200 (FIG. 2). Method 400 uses method 300 as is described below.

Method 300, performed by the processor 105, receives a sequence of N' frame features f(i) as input. When method 300 is substituted as step 220 in method 200, then the number of frames N' equals the number of features N. In step 305 the change-point m is set by the processor 105 to 1. The change-point m sets the point dividing the sequence of N' frame features f(i) into two separate sequences namely [1; m] and [m+1; N'].

Step 310 follows where the processor 105 calculates the log-likelihood ratio R(m) by first calculating the means and standard deviations $\{\mu_1,\sigma_1\}$ and $\{\mu_2,\sigma_2\}$ of the frame features f(i) before and after the change-point m. Equations (13), (15) and (16) are then calculated by the processor 105, and the results are substituted into Equation (14). The criterion difference ΔBIC for the Laplacian case having the change-point m is then calculated by the processor 105 using Equation (17) in step 315.

In step 320 the processor 105 determines whether the change point m has reached the end of the sequence of length N'. If the change-point m has not reached the end of the sequence, then the change-point m is incremented by the processor 105 in step 325 and steps 310 to 320 are repeated for the next change-point m. When the processor 105 determines in step 320 that the change-point m has reached the end of the sequence, then the method 300 proceeds to step 330 where the processor 105 determines whether a significant change in the sequence of N' frame features f(i) occurred by determining whether the maximum criterion difference max[ΔBIC(m)] has a value that is greater than a predetermined threshold. In the example, the predetermined threshold is set to 0. If the change was determined by the processor 105 in step 330 to be significant, then the method proceeds to step 335 where the most likely transition-point $\hat{m}$ is determined using Equation (18), and the result is provided to step 225 (FIG. 2) for processing and output to the user. Alternatively, in step 340 the null string is provided as output to step 225 (FIG. 2) while in turn informs the user that no significant transition could be detected in the audio signal.

FIG. 3B shows a flow diagram of the method 400 for detecting multiple transition-points $\hat{m}(j)$ within the sequence of N frame features f(i) that may be used as step 220 in method 200 shown in FIG. 2. Method 400 thus receives the sequence of N frame features f(i) from step 212 (FIG. 2) and provides the result to step 225 (FIG. 2) for processing and output to the user. Given an audio stream that is assumed to contain an unknown number of transition points $\hat{m}(j)$, the method 400 operates principally by analysing short sequences of frame features f(i), with each sequence consisting of $N_{min}$ frame features f(i), and detecting a single transition-point $\hat{m}(j)$ within each sequence, if it occurs, using method 300 (FIG. 3A). Once all the transition-points $\hat{m}(j)$ are detected, the method 400 performs a second pass wherein each of the transition-points $\hat{m}(j)$ detected are verified as being significant by analysing the sequence of frame features included in the segments either side of the transition-point $\hat{m}(j)$ under consideration, and eliminating any transition-points $\hat{m}(j)$ verified not to be significant. The verified significant transition-points $\hat{m}'(j)$ are then provided to step 225 (FIG. 2) for processing and output to the user.

Method 400 starts in step 405 where the sequence of frame features f(i) are defined by the processor 105 as being the sequence [f(a);f(b)]. The first sequence includes $N_{min}$ features and method 400 is therefore initiated with a=1 and $b=a+N_{min}$. The number of features $N_{min}$ is variable and is determined for each application. By varying $N_{min}$, the user can control whether short or spurious events should be detected or ignored, where the requirement being different with each scenario. In example, a minimum segment length of 1 second is assumed, thus given that the frame features f(i) are extracted every 10 ms, being the window shift time, the number of features $N_{min}$ is set to 100.

Step 410 follows where the processor 105 detects a single transition-point $\hat{m}(j)$ within the sequence [f(a);f(b)], if it occurs, using method 300 (FIG. 3A) with N'=b−a. In step 415 the processor 105 determines whether the output received from step 410, i.e. method 300, is a transition-point $\hat{m}(j)$ or a null string indicating that no transition-point $\hat{m}(j)$ occurred in the sequence [f(a);f(b)]. If a transition-point $\hat{m}(j)$ was detected in the sequence [f(a);f(b)], then the method 400 proceeds to step 420 where that transition-point $\hat{m}(j)$ is stored in the memory 106. Step 425 follows wherein a next sequence [f(a);f(b)] is defined by the processor 105 by setting $a=\hat{m}(j)+\delta_1$ and $b=a+N_{min}$, where $\delta_1$ is a predetermined small number of frames.

If the processor 105 determines in step 415 that no significant transition-point $\hat{m}(j)$ was detected in the sequence [f(a);(b)], then the sequence [f(a);f(b)] is lengthened by the processor 105 in step 430 by appending a small number $\delta_2$ of frame features f(i) to the sequence [f(a);f(b)] by defining $b=b+\delta_2$. From either step 425 or 430 the method 400 proceeds to step 435 where the processor 105 determines whether all N frame features f(i) have been considered. If all N frame features f(i) have not been considered, then control is passed by the processor 105 to step 410 from where steps 410 to 435 are repeated until all the frame features f(i) have been considered.

The method 400 then proceeds to step 440, which is the start of the second pass. In the second pass the method 400 verifies each of the N, transition-points $\hat{m}(j)$ detected in steps 405 to 435. The transition-point $\hat{m}(j)$ are verified by analysing the sequence of frame features included in the segments either side of a transition-point $\hat{m}(j)$ under consideration thus, when considering the transition-point $\hat{m}(j)$, the sequence $[f(\hat{m}'(j-1)+1);f(\hat{m}(j+1+n))]$ is analysed, with the verified transition-point $\hat{m}'(j)$ being set to 0. Accordingly, step 440 starts by setting a counter j to 1 and n to 0. Step 445 follows where the processor 105 detects a single transition-point $\hat{m}$ within the sequence $[f(\hat{m}'(j-1)+1);f(\hat{m}(j+1+n))]$, if it occurs, using again method 300 (FIG. 3A). In step 450 the processor 105 determines whether the output received from step 445, i.e. method 300, is a transition-point $\hat{m}$ or a null string indicating that no significant transition-point $\hat{m}$ occurred in the sequence $[f(\hat{m}'(j-1)+1);f(\hat{m}(j+1+n))]$. If a transition-point $\hat{m}$ was detected in the sequence $[f(\hat{m}'(j-1)+1);f(\hat{m}(j+1+n))]$, then the method 400 proceeds to step 455 where that transition-point $\hat{m}$ is stored in memory 106 and in a sequence of verified transition-points $\hat{m}'(\zeta)$. Step 460 follows wherein the counter j is incremented and n is reset to 0 by the processor 105. Alternatively if the processor 105 in step 450 determined that no significant transition-point $\hat{m}$ was detected by step 445, then the sequence $[f(\hat{m}'(j-1)+1);f(\hat{m}(j+1+n))]$ is merged by the processor 105 in step 465. The counter n is also incremented thereby extending the sequence of feature frames f(i) under consideration to the next transition-point $\hat{m}(j)$.

From either step 460 or 465 the method 400 proceeds to step 470 where it is determined by the processor 105 whether all the transition-points $\hat{m}(j)$ have been considered for verification. If any transition-points $\hat{m}(j)$ remain, control is returned to step 445 from where steps 445 to 470 are repeated until all the transition-points $\hat{m}(j)$ have been considered. The method 400 then passes the sequence of verified transition-points $\hat{m}'(\zeta)$ to step 225 (FIG. 2) for processing and output to the user.

Figure 8:
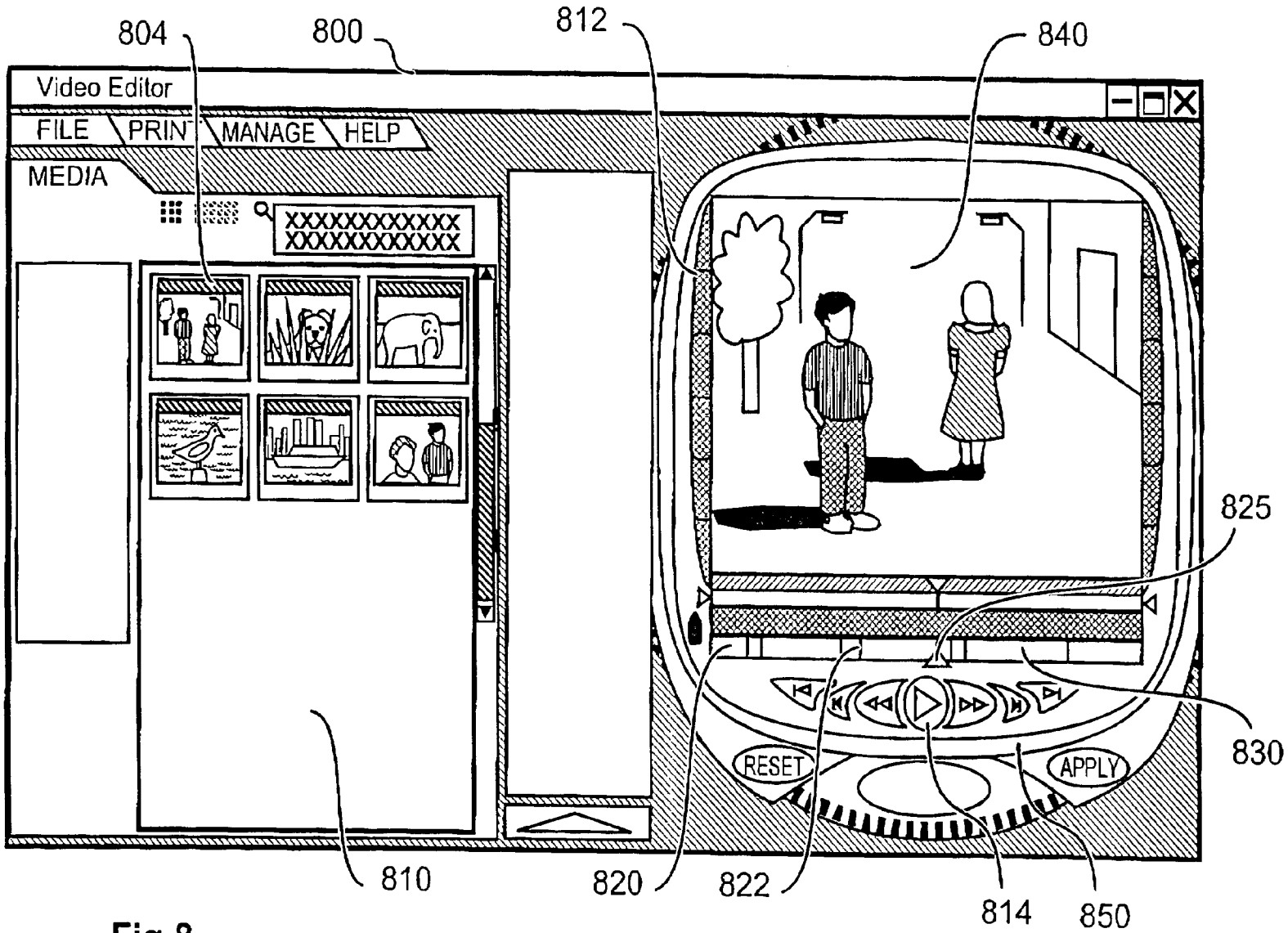
FIG. 8 shows a media editor within which the method for segmenting a sequence of sampled audio into homogeneous segments may be practiced.

FIG. 8 shows a media editor 800 within which the method 200 (FIG. 2) of segmenting a sequence of sampled audio into homogeneous segments may be practiced. In particular, the media editor 800 is a graphical user interface, formed on display 114 of system 100 (FIG. 1), of a media editor application, which is executed on the processor 105. The media editor 800 is operable by a user who wishes to review recorded media clips, which may include audio data and/or audio data synchronised with a video sequence, and wishes to construct a home production from the recorded media clips.

The media editor 800 includes a browser screen 810 which allows the user to search and/or browse a database or directory structure for media clips and into which files containing media clips may be loaded. The media clips may be stored as ".avi", ".wav", ".mpg" files or files in other formats, and typically is loaded from a CD-ROM/DVD inserted into the CD-ROM DVD drive 112 (FIG. 1).

Each file containing a media clip may be represented by an icon 804 once loaded into the browser screen 810. The icon 804 may be a keyframe when the file contains video data. When an icon 804 is selected by the user, its associated media content is transferred to the review/edit screen 812. More than one icon 804 may be selected, in which case the selected media content will be placed in the review/edit screen one after the other.

After selecting the aforementioned icons 804, a play button 814 on the review/edit screen 812 may be pressed. The media clip(s) associated with the aforementioned selected icon(s) 804 are played from a selected position and in the desired sequence, in a contiguous fashion as a single media presentation, and continues until the end of the presentation at which point playback stops. In the case where the media clip(s) contains video and audio data, then the video is displayed within the display area 840 of the review/edit screen 812, while the synchronised audio content is played over the loadspeakers 116 (FIG. 1). Alternatively, when the media clip only contains an audio sequence, then the audio is played over the loadspeakers 116. Optionally, some waveform representation of the audio sequence may be displayed in the display area 840.

A playlist summary bar 820 is also provided on the review/edit screen 812, presenting to the user an overall timeline representation of the entire production being considered. The playlist summary bar 820 has a playlist scrubber 825, which moves along the playlist summary bar 820 and indicates the relative position within the presentation presently being played. The user may browse the production by moving the playlist scrubber 825 along the playlist summary bar 820 to a desired position to commerce play at that desired position. The review/edit screen 812 typically also includes other viewing controls including a pause button, a fast forward button, a rewind button, a frame step forward button, a frame step reverse button, a clip-index forward button, and a clip-index reverse button. The viewer play controls, referred to collectively as 850, may be activated by the user to initiate various kinds of playback within the presentation.

The user may also initiate a segmentation function for segmenting the audio sequence associated with the selected media clip(s). Method 200 (FIG. 2) will read in the audio sequence and return transition-points $\hat{m}'(\zeta)$ as semantic event boundary locations. In one implementation, the transition-points $\hat{m}'(\zeta)$ determined by method 200 (FIG. 2) are indicated as transition lines 822 on the playlist summary bar 820. The transition lines 822 illustrate borders of segments, such as segment 830. The length of the playlist summary bar between the respective transition lines 822 represents the proportionate duration of an individual segment compared to the overall presentation duration.

In the case where the media clip(s) includes synchronised video and audio sequences, the transition lines 822 resulting from the audio segmentation also provides segmentation of the synchronised video sequence, based on the homogeneity of the audio sequence. Accordingly, the transition lines 822 also provide segmentation of the associated video.

The segments are selectable and manipulable by common editing commands such as "drag and drop", "copy", "paste", "delete" and so on. Automatic "snapping" is also provided whereby, in a drag and drop operation, a dragged segment is automatically inserted at a point between two other segments, thereby retaining the unity of the segments.

The user may thus edit the presentation, with the knowledge that the segment contained between consecutive transition lines 822 represents media content where the audio sequence is homogeneous. Such a segment could represent an event where only silence exists or one person is talking or one type of music is playing in the background. For example, the user may delete segments containing silence by selecting such segments and deleting them. If the segment contained a video sequence with synchronised audio, then the associated video would also be deleted. Similar conditions apply to the other commands.

In another example the segments provide to the user an advantageous means for compiling a presentation of audio sequences wherein a particular speaker is talking. The user only needs to listen to a small part of each segment to identify whether the segment contains that speaker. There is no need for an exhaustive search for transition points, which typically includes many pausing, rewinding and play operations to find such transition points.

Yet another application of the segmentation method 200 described herein is in an automatic audio classification system. In such a system, a media sequence which includes an audio sequence is first segmented using method 200 to determine the transition-points $\hat{m}'(\zeta)$. Known techniques may then be used to extract clip-level features from the audio samples within each segment. The extracted clip-level features are next classified against models of events of interest using statistical models known in the art. A label is then attached to each segment.

The models of events of interest arc typically obtained through a training stage wherein the user obtains clip-level features from manually labelled segments of interest. Such may be provided as described above in relation to FIG. 8.

The foregoing describes only some embodiments of the present invention, and modifications and/or changes can be made thereto without departing from the scope and spirit of the inventions, the embodiment(s) being illustrative and not restrictive.

I claim:

1. A method of segmenting a sequence of audio samples into a plurality of homogeneous segments, said method comprising the steps of:

(a) forming a sequence of frames along said sequence of audio samples, each said frame comprising a number of said audio samples;

(b) extracting, for each said frame, a data feature, said data features forming a sequence of said data features each corresponding to one of said frames;

(c) detecting one or more transition points in said sequence of data features by applying the Bayesian Information Criterion to said sequence of data features, said transition points defining said homogeneous segments; and (d) segmenting said sequence of audio samples according to said transition points, wherein said data feature for a given frame is formed by weighting a bandwidth extracted from the audio samples of the given frame with an energy value extracted from the audio samples of the given frame.

2. The method as claimed in claim 1, wherein a Laplacian distribution is used as an event model in said Bayesian Information Critenon.

3. The method as claimed in claim 1, wherein said frames are overlapping.

4. The method as claimed in claim 1, comprising the further step following step (a) of:

(a1) applying a Hamming window function to said audio samples in each of said frames.

5. An apparatus for segmenting a sequence of audio samples into a plurality of homogeneous segments, said apparatus comprising:

means for forming a sequence of frames along said sequence of audio samples, each said frame comprising a number of said audio samples;

means for extracting, for each said frame, a data feature, said data features forming a sequence of said data features each corresponding to one of said frames; and means for detecting one or more transition points in said sequence of data features by applying the Bayesian Information Criterion to said sequence of data features; and means for segmenting said sequence of audio samples according to said transition points, said transition points defining said homogeneous segments, wherein said data feature for a given frame is formed by weighting a bandwidth extracted from the audio samples of the given frame with an energy value extracted from the audio samples of the given frame.

6. The apparatus as claimed in claim 5, wherein a Laplacian distribution is used as an event model in said Bayesian Information Criterion.

7. The apparatus as claimed in claim 5, wherein said frames are overlapping.

8. The apparatus as claimed in claim 5, further comprising means for applying a Hamming window function to said audio samples in each of said frames before said data feature is extracted.

9. A computer-readable medium encoded with a computer program for segmenting a sequence of audio samples into a plurality of homogeneous segments, said program comprising:

code for forming a sequence of frames along said sequence of audio samples, each said frame comprising a number of said audio samples;

code for extracting, for each said frame, a data feature, said data features forming a sequence of said data features each corresponding to one of said frames; and code for detecting one or more transition points in said sequence of data features by applying the Bayesian Information Criterion to said sequence of data features; and code for segmenting said sequence of audio samples according to said transition points, said transition points defining said homogeneous segments, wherein said data feature for a given frame is formed by weighting a bandwidth extracted from the audio samples of the given frame with an energy value extracted from the audio samples of the given frame.

10. The program as claimed in claim 9, wherein a Laplacian distribution is used as an event model in said Bayesian Information Critenon.

* * * * *

UNITED STATES PATENT AND TRADEMARK OFFICE

CERTIFICATE OF CORRECTION

PATENT NO. : 7,243,062 B2
APPLICATION NO. : 10/279720
DATED : July 10, 2007
INVENTOR(S) : Timothy John Wark It is certified that error appears in the above-identified patent and that said Letters Patent is hereby corrected as shown below:

ON THE TITLE PAGE
At Item (57), Abstract, line 7 "thin" should be --then--.

COLUMN 6
Line 58, "FIG. 5A:" should read --FIG. 5A--.

COLUMN 7
Line 5, "OF" should read --of--.
Line 60,

" $$L = \prod_{i=1}^{N}\left(\left(2\sigma^2\right)^{-\frac{1}{2}} \exp\left(-\frac{\sqrt{2}}{\sigma}\left|f(i)-\mu\right|\right)\right)$$ "

should read

-- $$L = \prod_{i=1}^{N}\left(\left(2\sigma^2\right)^{-\frac{1}{2}} \exp\left(-\frac{\sqrt{2}}{\sigma}\left|f(i)-\mu\right|\right)\right)$$ --.

COLUMN 12
Line 42, "arc" should read --are--.

UNITED STATES PATENT AND TRADEMARK OFFICE

CERTIFICATE OF CORRECTION

PATENT NO. : 7,243,062 B2
APPLICATION NO. : 10/279720
DATED : July 10, 2007
INVENTOR(S) : Timothy John Wark It is certified that error appears in the above-identified patent and that said Letters Patent is hereby corrected as shown below:

COLUMN 13

Line 25, "features;" should read --features, said transition points defining said homogeneous segments;--.
Line 28, "said transition" (second occurrence) should be deleted.
Line 29, "points defining said homogeneous segments," should be deleted.

COLUMN 14

Line 21, "features;" should read --features, said transition points defining said homogeneous segments;--.
Line 25, "said transition" (second occurrence) should be deleted.
Line 26, "points defining said homogeneous segments," should be deleted.

Signed and Sealed this

Third Day of June, 2008

JON W. DUDAS
*Director of the United States Patent and Trademark Office*